United States Patent [19]

Gontar

[11] 4,055,275

[45] Oct. 25, 1977

[54] RETAINABLE TAB CONSTRUCTION FOR SEALED CANS

[76] Inventor: Herbert Gontar, 6 Westchester Ave., Pound Ridge, N.Y. 10576

[21] Appl. No.: 756,368

[22] Filed: Jan. 3, 1977

[51] Int. Cl.[2] ..... B65D 41/32

[52] U.S. Cl. ..... 220/269; 220/270; 220/274

[58] Field of Search ..... 220/268–274, 220/277; 222/541

[56] References Cited

U.S. PATENT DOCUMENTS

| | | | |
|---|---|---|---|
| 1,961,909 | 6/1934 | Omsted | 220/274 |
| 3,830,399 | 8/1974 | Hill | 220/270 |

*Primary Examiner*—George T. Hall

*Attorney, Agent, or Firm*—Kane, Dalsimer, Kane, Sullivan and Kurucz

[57] ABSTRACT

A "pop-top" or "snap-open" can is provided with means for retaining the tab defined by a weakened section, following its severence from the top for opening the can. A rivet extends upwardly from the weakened portion and is engaged with an elongated key having a handle at one end. The shank of the key is provided with a slot through which the rivet extends so that the key is slidable between a first position at which the key is disposed within the periphery of the can top and a second position at which the handle extends beyond the can top periphery. In this extended position the handle may be manually grasped and digitally twisted for purposes of severing the tab from the top by twisting or curling it around the shank of the key. A second rivet extends upwardly from the top and is provided with a swivel connection for the key that permits its twisting motion; and, at the same time, the retained key may be pivoted away from the can top opening after the tab has been severed. Raised projections on the top of the can are adapted to receive the shank of the key to latch the key with severed tab in place away from the opening and consequently away from the face of the consumer.

14 Claims, 7 Drawing Figures

RETAINABLE TAB CONSTRUCTION FOR SEALED CANS

BACKGROUND OF THE INVENTION

Ever since the advent of the snap open or pop top beverage cans a number of inherent problems have plagued this industry and particularly the consuming public. Inasmuch as these tabs were removable, they inevitably would be discarded in a fashion that would not only contaminate the environment but would be dangerous to humans, animals and fish. Aside from the unsightlyness of discarded tabs, they would inflict cuts on many people at beaches and elsewhere at which it would not be uncommon for people to walk barefooted. There are many reported cases of animals and fish swallowing the tabs while feeding which consequently led to death. In addition, there are many reported cases of people swallowing the tabs after having put the tabs in the can rather than throwing them away.

Recently there has been introduced a tab construction which would retain the tab on the can top. This new top construction is opened by pulling the tab up and then pushing it back to its original position. This would have the effect of severing a weakened section of the top and then pivoting it downwardly into the interior of the can while still retained by the tab. However, this form of top construction offers a number of problems and disadvantages. First of all, the tab in many instances hits the consumer or drinker on the nose because unless manipulated properly it will extend vertically up from the can top. Most important of all is the unsanitary nature of the construction which permits an unclean and contaminated exterior surface of the weakened portion to be pivoted down into the contents of the can. Quite obviously not every consumer will take the time to clean or otherwise disinfect the can top prior to opening the can and consuming its contents.

SUMMARY OF THE INVENTION

The principal object of the present invention is to solve and eliminate the problems, disadvantages and drawbacks of the original non-retainable pop top or snap open type of cans as well as the recently introduced tab retaining top construction for beverage cans.

Another object is to provide an improved can top construction having a retainable tab that is readily severed from the top to provide an opening to the can interior and at the same time permit the retained tab to be shifted away from the opening so that it does not come in contact with the can contents or the person and particularly the face of the consumer.

A further object of the invention is to provide retainable tab construction for sealed cans which when the contents of the can have been consumed, the entire can may be disposed as a unit.

Other objects and advantages will become apparent from the detailed description which is to be taken in conjunction with the accompanying drawings.

DETAILED DESCRIPTION

Figure 1:
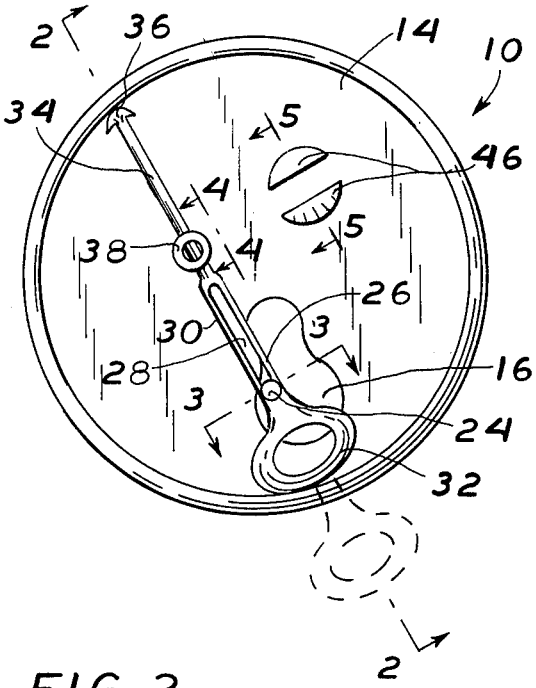
FIG. 1 is a top plan view of a sealed can with a retained tab construction in accordance with the invention.

In the drawings, a can 10 is shown and includes the usual cylindrical side wall 12 and base (not shown) together with the top 14 modified in accordance with the teachings of this invention. In this connection, the top is secured to the side wall in any manner well known to the art and is provided with weakened section 16 which may assume the illustrated or any other configuration. Furthermore the manner of providing a weakened periphery for this section 16 which defines the removable tab is known to the art with such weakening being incorporated in commercially available "snap-open or pop-top" beverage cans. A rivet 18 extends upwardly from the weakened section and they also assume a form and configuration well known in the art. Accordingly the rivet 18 includes two spaced flanges 20 and 22 in sealing engagement with the weakened section 16 of the can top 14. The rivet 18 is also provided with an upper enlarged head 24.

A key 26 is in sliding engagement with the interconnecting rivet 18 from an inner position at which it is within the confines of the periphery of the can top 14 (see FIGS. 1 and 2) and an extended position at which it may be readily manually grasped and digitally manipulated by turning for purposes of removing the tab defined by the weakened section 16. In order to facilitate and attain these positions the key may be slightly bowed, as clearly shown in FIG. 2. The key 26 is provided with an elongated slot 28 in shank 30 intermediate its ends for receiving the shank portion of the rivet 18 to thereby facilitate the connection of the key 26 to the rivet 18 while maintaining relative sliding movement therebetween. The key 26 is also provided with a finger gripping handle 32 adapted to be manually grasped with the consumers' fingers to facilitate turning thereof and consequent twisting of the tab about the shank 30.

The opposite end of the key includes a reduced cylindrical section 34 extending from the shank 30 and which includes an enlarged tip 36 formed in any manner as for example by flattening the cylindrical section 34.

Once the tab 16 is removed and curled around the shank 30 of the key 26, the key with curled tab 16 is adapted to remain secured to the can top 14 by the interengagement of the cylindrical section 34 and the swivel 38 which is essentially tubular in configuration with a radially and inwardly extending flange 40 which couples with rivet 42 both of which are sealingly engaged with the top 14 in known manner while permitting pivotal movement of the key 26. The swivel 38 is also provided with a pair of aligned openings 44 which receive the cylindrical section 34 and at the same time permit twisting of the key 26 for purposes of removing the tab 16. The enlarged tip 36 is larger than the size of the openings 44 in order to prevent the key 26 from becoming disassociated with the swivel 38.

Figure 7:
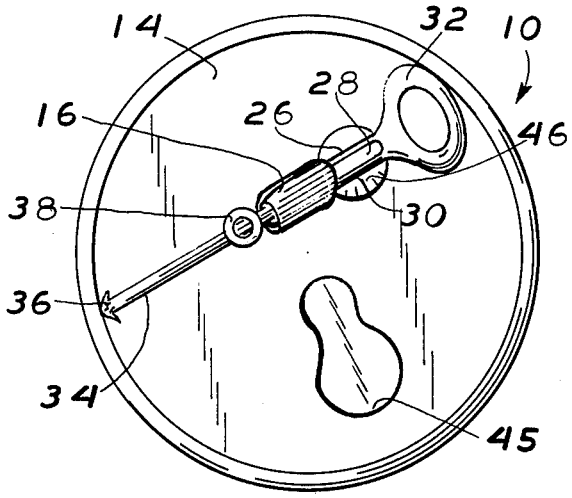
FIG. 7 is a top plan view of the open can with the key and removed curled tab latched in a position away from the can opening and consequently away from the consumers' mouth.
Figure 6:
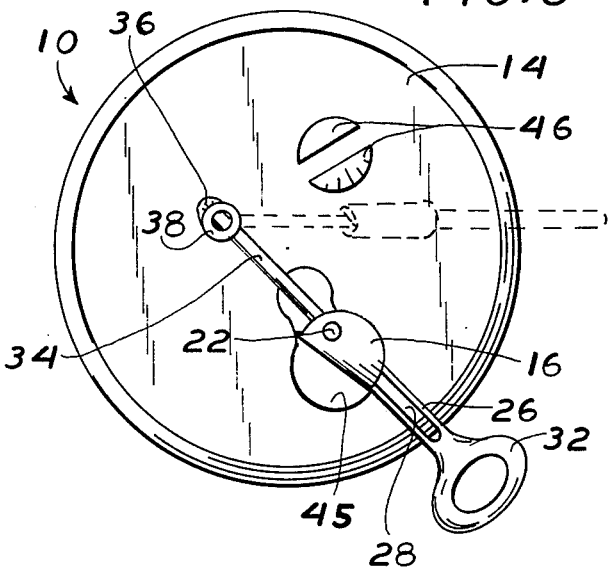
FIG. 6 is a top plan view showing the key extended outwardly and in the process of being twisted for purposes of removing the tab from the line of weakening with phantom designation showing the key and removed tab being shifted away from the can top opening.
Figure 3:
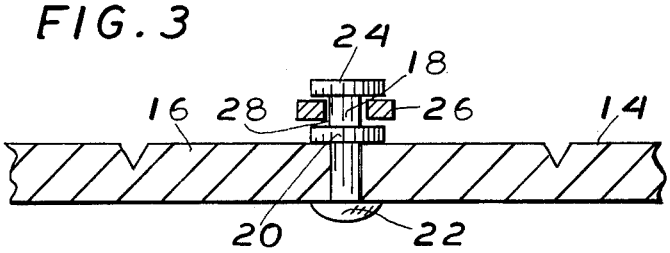
FIG. 3 is an enlarged fragmentary cross-sectional view taken along the line 3—3 of FIG. 1.
Figure 4:
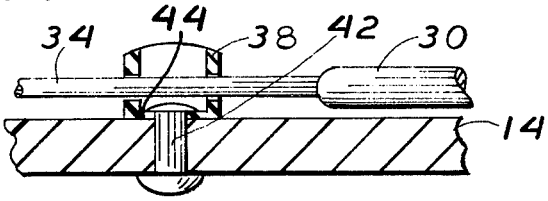
FIG. 4 is an enlarged fragmentary cross-sectional view taken along the line 4—4 of FIG. 1.
Figure 5:
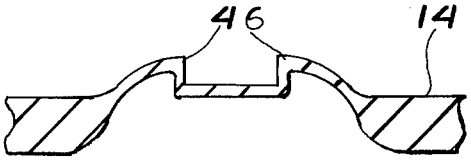
FIG. 5 is an enlarged fragmentary cross-sectional view taken along the line 5—5 of FIG. 1.

Once the tab 16 has been removed and curled about the shank 30 of the key 26, the key with curled tab 16 may be pivoted away from the can top opening 45 by means of the swivel 38 as shown in phantom in FIG. 6 to a latched position as shown in FIG. 7. In this connection, a pair of raised projections 46 advantageously receive the shank 30 of the key 26 and latch the key with curled tab in the position shown in FIG. 7. Towards this end, and only if desired, the key with curled tab may be slid inwardly in order to have the key disposed entirely within the periphery of the can top 14. Thus the contents of the can may now be consumed either by emptying the can contents without being exposed to exterior surfaces of the tab 16 or consumed directly from the can by the consumer without touching the face and particularly the nose of the consumer.

Figure 2:
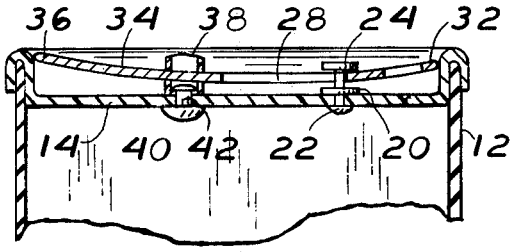
FIG. 2 is a fragmentary longitudinal sectional view taken along the line 2—2 of FIG. 1.

In summary, the sealed can with its contents which will be taken to be a beverage for descriptive purposes only, will have its top 14 and accompanying parts disposed as shown in FIGS. 1 and 2. When it is desired to consume the beverage, the key 26 is extended to the position shown in phantom shown in FIG. 1 as the result of the relative sliding movement of the rivet 18 and the slot 28 in the shank 30 of the key 26. Thereafter the key 26 is manually grasped at the handle 32 and digitally turned or twisted as represented by FIG. 6 with the cylindrical section 34 turning within the openings 44 in the swivel 38 which also permits pivotal movement of the key during the twisting operation. When the tab 16 has been curled about the shank 30 of the key 26 as shown in phantom in FIG. 6, the key 26 with curled tab 16 may be pivoted further to a latched position as shown in FIG. 7. In this position, the raised projections 46 conveniently receive therebetween the shank portion 30 of the key which if desired may be shifted or slid inwardly to have the key with curled tab disposed interiorly of the periphery of the can top 14. The contents of the can may now be consumed through the opening 45 with the key and curled tab remaining secured to the can top both during consumption and thereafter following disposal.

Thus, the several aforenoted objects and advantages are most effectively attained. Although a single somewhat preferred embodiment of the invention has been disclosed and described in detail herein, it should be understood that this invention is in no sense limited thereby and its scope is to be determined by that of the appended claims.

I claim:

1. A sealed can comprising: a top, side walls, and a bottom defining a sealed interior compartment, the top having a weakened section defining a tab adapted to be disassociated from the top to provide access to the interior compartment, a first key engaging means extending from the weakened section, an elongated substantially rigid key, first connecting means for slidably connecting the key and key engaging means to facilitate manual engagement of the key and digital manipulation thereof to sever the tab from the top to provide a top opening defined by the weakened section, a second key engaging means extending from the top, and second connecting means for shifting the key and severed tab away from the opening to permit access to the interior compartment without interference from the key and severed tab.

2. The invention in accordance with claim 1, wherein the first key engaging means includes a rivet having a lower end in sealing engagement with surfaces of the weakened section of the top and an upper head projecting beyond the top in engagement with the key, and the first connecting means includes an elongated slot in the key for receiving the rivet, with the rivet head being larger then the transversed dimension of the slot for purposes of slidably connecting the key to the rivet.

3. The invention in accordance with claim 1, wherein the key is slidable from a first position at which it is disposed interiorly of the periphery of the top and a second position at which manual engagable portions of the key extend beyond the periphery of the top to facilitate digital manipulation of the key to sever the tab from the top.

4. The invention in accordance with claim 3, wherein twisting means are provided for permitting twisting of the key when in the second position to sever the tab from the top by curling the weakened portion about the key as the key is twisted.

5. The invention in accordance with claim 4, wherein limiting means are provided for limiting the longitudinal movement between the first and second positions.

6. The invention in accordance with claim 5, wherein the limiting means further includes stop means which restricts the movement of the key relative to the second connecting means after the tab has been severed from the top and moved away from the opening.

7. The invention in accordance with claim 1, wherein the second connecting means is defined by a pivotal connection between the key and second key engaging means to permit the key with severed tab to be shifted away from the opening.

8. The invention in accordance with claim 7, wherein limiting means are provided for limiting the longitudinal movement between the first and second positions.

9. The invention in accordance with claim 8, wherein the limiting means further includes stop means which restricts the movement of the key relative to the second connecting means after the tab has been severed from the top and moved away from the opening.

10. The invention in accordance with claim 7, wherein the pivotal connection also permits twisting of the key to sever the tab from the top.

11. The invention in accordance with claim 7, wherein both of the second means cooperate to retain the key on the can top following severence of the tab from the top.

12. The invention in accordance with claim 1, wherein the key includes a handle at one end and a stop at the other and engagable with the second key engaging means.

13. The invention in accordance with claim 1, wherein interengaging surfaces of the key and a pair of spaced raised projections extending upwardly from the top define latching means to latch the key securely between the space between the projections after the key with severed tab has been shifted away from the opening.

14. The invention in accordance with claim 1, wherein the first key engaging means includes a rivet having a lower end in sealing engagement with surfaces of the weakened section of the top and an upper head projecting beyond the top in engagement with the key, and the first connecting means including an elongated slot in the key for receiving the rivet, with the rivet head being larger then the transversed dimension of the slot for purposes of slidably connecting the key to the rivet, the key having a handle at one end, the key being slidable from a first position at which it is disposed interiorly of the periphery of the top and a second position at which the handle of the key extends beyond the periphery of the top to facilitate digital manipulation of the key to sever the tab from the top, the key when in the second position being adapted to sever the tab from the top by curling the weakened portion about the key as the key is twisted, limiting means are provided for limiting the longitudinal movement between the first and second positions, the limiting means further includes stop meas which restricts the movement of the key relative to the second connecting means after the tab has been severed from the top and moved away from the opening, the second connecting means being defined by a pivotal connection between the key and second key engaging means to permit the key with severed tab to be shifted away from the opening, the pivotal connection permitting twisting of the key to sever the tab from the top, the key includes a stop at the other end engagable with the second key engaging means for retaining the key on the top after the tab has been severed from the top, interengaging surfaces of the key and a pair of spaced raised projections extending upwardly from the top define latching means to retain the key securely between the space between the projections after the key with severed tab has been shifted away from the opening.

* * * * *